US007292813B2

(12) United States Patent
Ichizawa

(10) Patent No.: US 7,292,813 B2
(45) Date of Patent: Nov. 6, 2007

(54) INTERMEDIATE TRANSFER BELT, PRODUCTION METHOD FOR THE SAME, AND IMAGE FORMING DEVICE PROVIDED WITH THE SAME

(75) Inventor: Nobuyuki Ichizawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 136 days.

(21) Appl. No.: 11/202,140

(22) Filed: Aug. 12, 2005

(65) Prior Publication Data

US 2006/0045578 A1 Mar. 2, 2006

(30) Foreign Application Priority Data

Aug. 31, 2004 (JP) ..... 2004-253303
Dec. 21, 2004 (JP) ..... 2004-369526

(51) Int. Cl.
*G03G 15/16* (2006.01)
*G03G 15/01* (2006.01)

(52) U.S. Cl. ..... 399/308; 399/302

(58) Field of Classification Search ..... 399/302, 399/308; 430/48, 126, 125.32
See application file for complete search history.

(56) References Cited

U.S. PATENT DOCUMENTS 3,893,761 A * 7/1975 Buchan et al. ..... 399/308
6,728,502 B2 * 4/2004 Hara ..... 399/302 X
6,856,782 B2 * 2/2005 Takahata et al. ..... 399/302
2004/0136760 A1 * 7/2004 Yoshida et al. ..... 399/302

FOREIGN PATENT DOCUMENTS

JP 62-206567 A 9/1987
JP 5-77252 A 3/1993
JP 10-063115 A 3/1998

* cited by examiner

*Primary Examiner*—Sandra L. Brase
(74) *Attorney, Agent, or Firm*—Oliff & Berridge, PLC

(57) ABSTRACT

The present invention provides an intermediate transfer belt, wherein: the intermediate transfer belt is made from a resin material comprising a carbon black in a dispersed state; an absolute value of a difference between a common logarithm value of surface resistivity 10 seconds after voltage application and a common logarithm value of the surface resistivity 30 milliseconds after voltage application is about 0.2 ((Log Ω/□) or less; and a Young's modulus thereof is about 3,500 MPa or more. The intermediate transfer belt is preferably formed by a process comprising: dispersing the carbon black in a polyamide acid solution to prepare a dispersant; developing the dispersant in a ring-like shape to form a developing layer; drying the developing layer to make a film to mold into a belt shape to form a molded article; and heat-treating the molded article to convert polyamide acid into imide.

20 Claims, 2 Drawing Sheets

FIG. 2
FIG. 2A
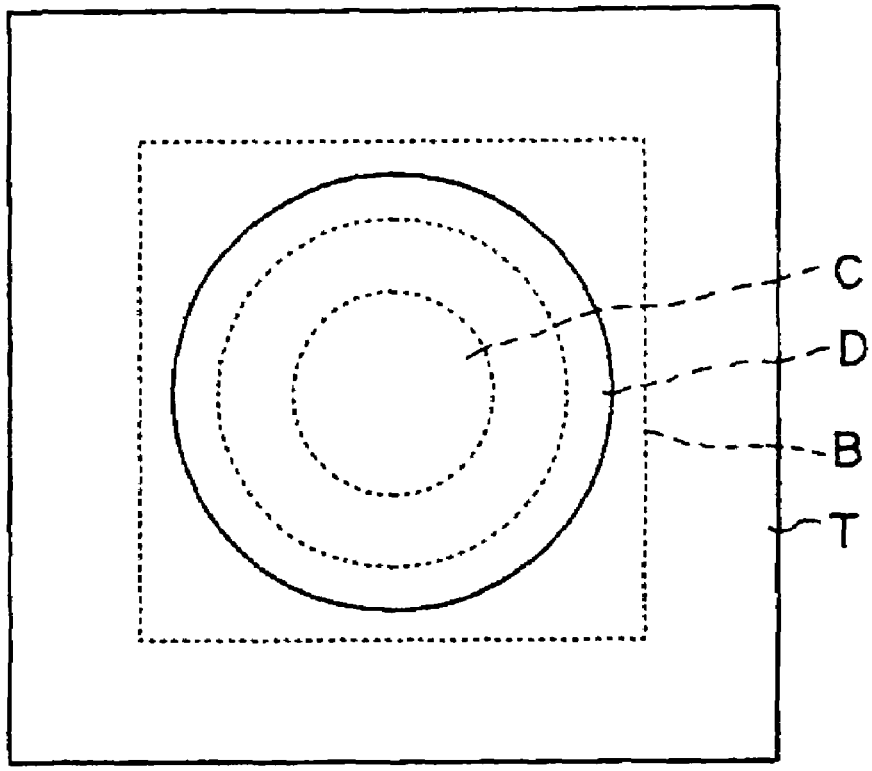
FIG. 2B
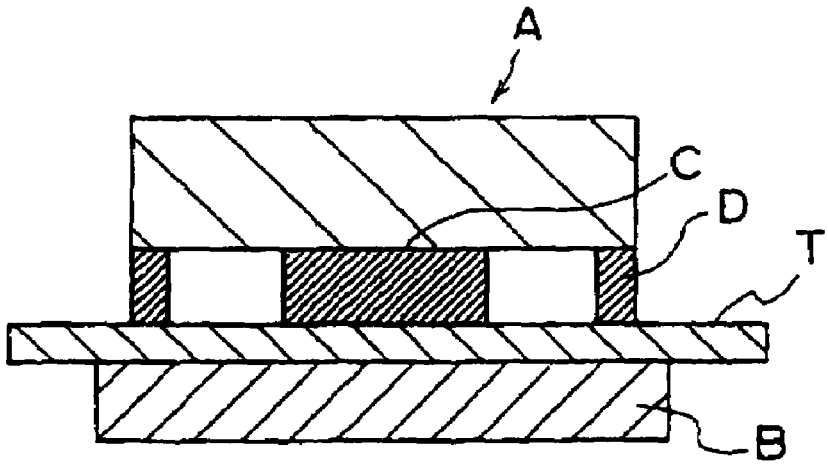

INTERMEDIATE TRANSFER BELT, PRODUCTION METHOD FOR THE SAME, AND IMAGE FORMING DEVICE PROVIDED WITH THE SAME

CROSS-REFERENCE TO RELATED APPLICATION

This application claims priority under 35 USC 119 from Japanese Patent Application Nos. 2004-253303 and 2004-369526, the disclosures of which are incorporated by reference herein.

BACKGROUND OF THE INVENTION

1. Field of Invention

The invention relates to an image forming device utilizing an electrophotography format such as an electrophotography copying machine, a laser printer, a facsimile or composite OA equipment thereof, and to an electrically conductive member used therein. More specifically, the invention relates to an image forming device in which a toner image formed on an image bearing body is primarily transferred onto an intermediate transfer belt and, thereafter, the toner image is secondarily transferred onto a recording medium such as a paper to obtain an image, and to an intermediate transfer belt.

2. Description of the Related Art

In an image forming device using an electrophotography format, a uniform charge is formed on an image bearing body which is a photoconductive photoreceptor comprising an inorganic or organic material, an electrostatic latent image is formed by an image signal modulated by laser light, and the electrostatic latent image is developed with an electrified toner to obtain a visualized toner image. Then, by electrostatically transferring the toner image onto a transfer material such as a recording paper via an intermediate transfer body or directly, a required regenerated image is obtained. In particular, as an image forming device adopting a format of primarily transferring a toner image formed on the image bearing body onto an intermediate transfer body, and further secondarily transferring a toner image on an intermediate transfer body onto a recording paper, the device disclosed in Japanese Patent Application Laid-Open (JP-A) No. 62-206567 is known.

Since an electrically conductive material formed of a thermoplastic resin such as a polycarbonate resin or PVDF (polyvinylidene fluoride) used in an image forming device adopting the intermediate transfer body format is inferior in mechanical property, belt deformation relative to stress at driving is great, and a transferred image of high quality cannot be stably obtained. In addition, an elastic belt with a reinforcing material therein in which a woven fabric of polyester and an elastic member are laminated has been proposed, but the problem of color slippage due to creep deformation of a belt material with time arises in some cases.

Accordingly, JP-A Nos. 5-77252 and 10-63115 propose an intermediate transfer belt in which an electrically conductive filler is disposed in a polyimide resin excellent in mechanical strength and heat resistance.

In an image forming device adopting the intermediate transfer body format, a charge upon primary transfer influences the potential on a photoreceptor surface, and insufficient electrification and a spot-like defect are generated in some cases. By using a belt-shaped intermediate transfer body having a large degree of design freedom, and arranging a photoreceptor and 1st-BTR (primary transferroll) in an offset position, the influence on the potential on a photoreceptor at primary transfer can be reduced. By offsetting, the transfer function exhibits a close relationship with the surface resistance of an intermediate transfer belt.

On the other hand, in a device performing printing treatment at a high speed, the problems of concentration scattering and spot-like defects occur.

SUMMARY OF THE INVENTION

When high speed printing is performed with an image forming device, it is necessary to improve the transfer efficiency of primary transfer and reduce image defects due to discharge. When printing is performed at a high speed, in primary transfer, it is necessary to transfer a toner image from a photoreceptor onto an intermediate transfer belt in a short time, and a high primary transfer current is applied in a short time. A primary transfer current causes discharge from an intermediate transfer belt to a photoreceptor (image bearing body), and the defect of a discharge mark is caused at a non-printing part or a half tone image part due to the reduction in the photosensitive electrification potential. In addition, since transfer is performed in a short time, high transfer efficiency is necessary, and the system problem occurs that an image is left white due to defective transfer, and the acceptable width of the primary current is narrow.

Accordingly, in consideration of the various existing problems, the invention provides an image forming device which does not cause unevenness in image concentration or spot-like defects even in high speed printing, is provided with an intermediate transfer belt that can be applied to a wide range of devices, and gives a high transfer efficiency at speed high printing and high image quality without discharge mark.

As a result of a research by the inventors, the following matters have been revealed. First, image defects are caused by a discharge which occurs in a gap generated between a belt and a photoreceptor, which gives a charge history to a photoreceptor. Since primary transfer is performed onto a belt at a high speed and a high primary current, and the belt is conveyed at a high speed, the discharge occurs when peeling the belt from a photoreceptor. It was discovered that although it is difficult to avoid this problem by adjusting belt tension on a system or the angle of each attached member, the problem can be avoided by increasing the density of a charge on a photoreceptor surface.

On the other hand, it was discovered that defective transfer is derived from the surface resistance time constant of an intermediate transfer belt. That is, it was discovered to be necessary that intermediate transfer belt resistance is constant during transfer, and a stable electric field is formed. While it is difficult to compare changes in intermediate transfer belt resistance at an actual primary transfer region, it became clear that transfer efficiency increased in a belt having a small difference between the surface resistivity thereof evaluated after about 10 sec and the surface resistivity thereof evaluated after about 30 msec.

Namely, the present invention provides an intermediate transfer belt, wherein: the intermediate transfer belt is made from a resin material comprising a carbon black in a dispersed state; an absolute value of a difference between a common logarithm value of surface resistivity 10 seconds after voltage application and a common logarithm value of the surface resistivity 30 milliseconds after voltage application is about 0.2 (Log Ω/□) or less; and a Young's modulus thereof is about 3,500 MPa or more.

In one embodiment, the intermediate transfer belt of the present invention is formed by a process comprising: dispersing the carbon black in a polyamide acid solution so as to prepare a dispersant; developing the dispersant in a ring-like shape to form a developing layer; drying the developing layer to make a film to mold into a belt shape to form a molded article; and heat-treating the molded article to convert polyamide acid into imide.

The present invention further provides an image forming device comprising: a first transfer apparatus for primarily transferring a toner image formed on an image bearing body onto the intermediate transfer belt; and a second transfer apparatus for secondarily transferring the toner image transferred onto the intermediate transfer belt onto a transfer medium.

BRIEF DESCRIPTION OF THE DRAWINGS

FIG. 2 is a schematic plane view (FIG. 2A) and a schematic cross-sectional view (FIG. 2B) showing one example of a circular electrode for measuring the surface resisitivity of an intermediate transfer belt.

DETAILED DESCRIPTION OF THE INVENTION

Figure 1:
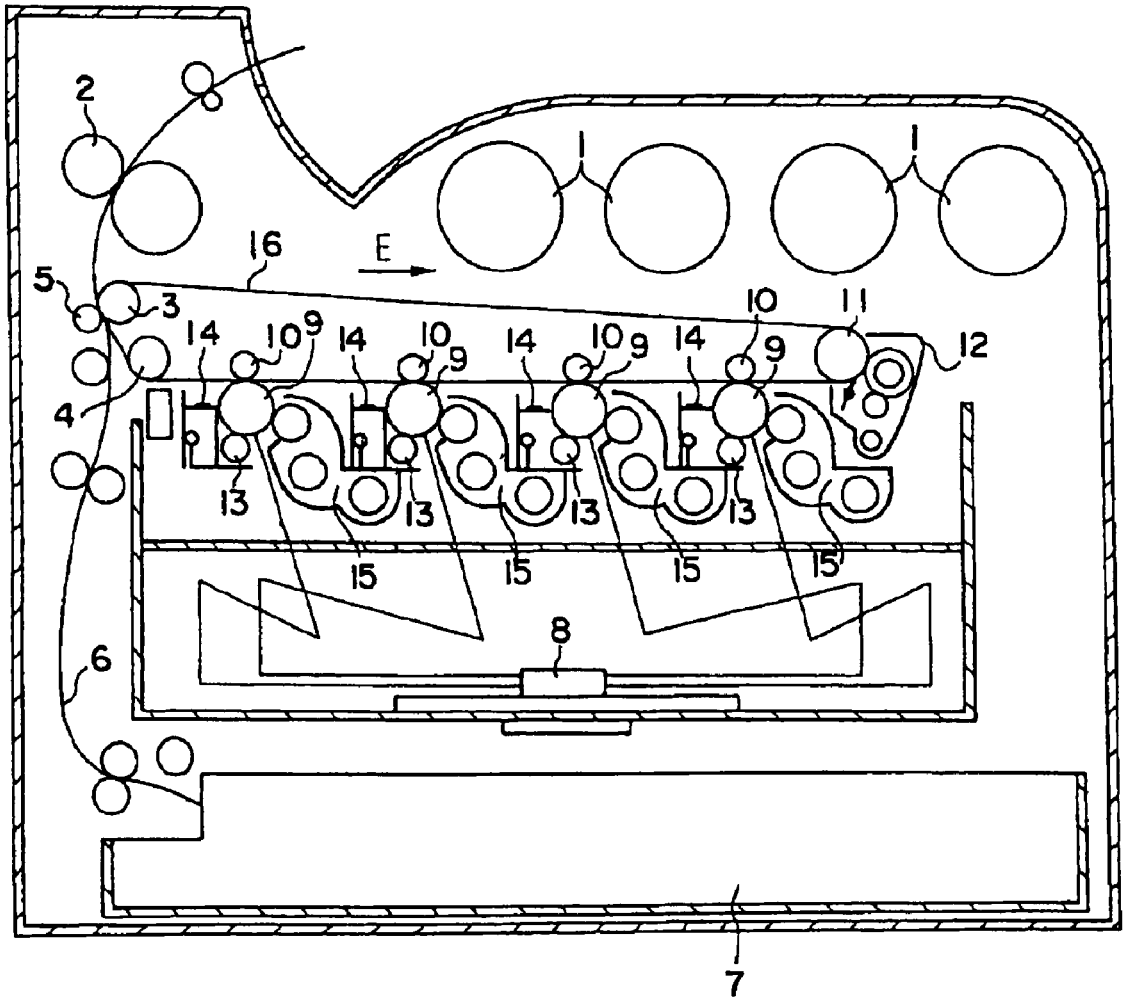
FIG. 1 is a schematic view showing one example of an image forming device of the present invention.

The image forming device of the present invention contains at least: a first transfer apparatus for primarily transferring a toner image formed on an image bearing body onto an intermediate transfer belt; and a second transfer apparatus for secondarily transferring the toner image transferred onto the intermediate transfer belt onto a transfer medium. The intermediate transfer belt is made from a resin material comprising a carbon black in a dispersed state; an absolute value of a difference between a common logarithm value of surface resistivity 10 seconds after voltage application and a common logarithm value of the surface resistivity 30 milliseconds after voltage application is 0.2 ((Log Ω/□) or less; and a Young's modulus thereof is 3500 MPa or more.

The image forming device of the invention is not particularly limited insofar as it belongs to an intermediate transfer body format, that is, an image forming device having a structure provided with at least a first transfer means(/apparatus) for primarily transferring a toner image formed on an image bearing body onto an intermediate transfer belt, and a second transfer means(/apparatus) for secondarily transferring a toner image transferred on the intermediate transfer belt, onto a transfer body. Examples of the image forming device of the invention include a normal monocolor image forming device in which only single color toners are accommodated in a developing device, a color image forming device in which successive primary transfer of a toner image held on an image bearing body onto an intermediate transfer body is repeated, and a tandem-type color image forming device in which a plurality of image bearing bodies provided with developing equipment for every color are arranged on an intermediate transfer body in series.

In addition, according to known methods, the image forming device of the invention may be optionally provided with an image bearing body, an electrification means for electrifying an image bearing body surface, an exposing means for exposing an image bearing body surface to the light to form an electrostatic latent image, a developing means for developing a latent image formed on an image bearing body surface using a developer to form a toner image, a means for fixing a toner image on a transfer body, a cleaning means for removing a toner and refuse attached to an image bearing body, and a discharging means for removing an electrostatic latent image remaining on an image bearing body surface, if necessary.

In addition, the image forming device of the invention relates to a device which can perform high speed printing. Since a toner image is transferred onto an image bearing body, an intermediate transfer belt and a recording medium, and further the image is printed in the device, the rate of conveyance at each of the steps determines the printing rate. It is preferable that a member of a high speed machine has a rate of conveying a paper (hereinafter, also referred to as process speed) of about 200 mm/sec or higher.

A specific embodiment of a tandem-type color image forming device will be explained below using the drawings.

FIG. 1 is a schematic view showing one example of the image forming device of the invention. The image forming device showed in FIG. 1 contains, as principal constituent members, four toner cartridges 1, one pair of fixing rolls 2, a back-up roll 3, a tension roll 4, a secondary transfer roll (secondary transfer means) 5, a paper path 6, a paper tray 7, a laser-generating device 8, four photoreceptors (image bearing bodies) 9, four primary transfer rolls (primary transfer means) 10, a driving roll 11, a transfer cleaner 12, four electrification rolls 13, a photoreceptor cleaner 14, a developing device 15, and an intermediate transfer belt 16. In the image forming device shown in FIG. 1, an intermediate transfer belt of the invention is used as an intermediate transfer belt 16 which functions as a means for overlaying toner images, and a means for transferring a toner image.

Next, construction of an image forming device as shown in FIG. 1 will be explained in stages. First, an electrification roll 13, a developing device 15, a primary transfer roll 10 disposed via an intermediate transfer belt 16, and a photoreceptor cleaner 14 are arranged counterclockwisely around a photoreceptor 9, and one set of these members form a developing unit corresponding to one color. In addition, each of these developing units is provided with a toner cartridge 1 for replenishing developer to each developing device 15, and a laser-generating device 8 which can irradiate laser light to a surface of the photoreceptor 9 between the electrifying roll 13 and the developing device 15 according to image information is provided relative to the photoreceptor 9 of each developing unit.

Four developing units corresponding to four colors (e.g. cyan, magenta, yellow, and black) are arranged in series in an approximately horizontal direction in an image forming device, and an intermediate transfer belt 16 is provided so as to pass through a nip part between the photoreceptor 9 and the primary transfer roll 10 of each of the four developing units. The intermediate transfer belt 16 is stretched by a back-up roll 3, a tension roll 4, and a driving roll 11 which are provided in this order counterclockwisely on its inner circumferential side. Four primary transfer rolls are situated between the back-up roll 3 and the tension roll 4. A transfer cleaner 12 for cleaning an external circumferential surface of the intermediate transfer belt 16 is provided so as to contact with the driving roll 11 under pressure, via the intermediate transfer belt 16, on an opposite side of the driving roll 11.

In addition, a secondary transfer roll 5 for transferring a toner image formed on the external circumferential surface of the intermediate transfer belt 16 onto a surface of a recording paper conveyed from a paper tray 7 via a paper path 6 is provided so as to contact with the back-up roll 3 under pressure, on an opposite side of the back-up roll 3 via the intermediate transfer belt 16. On the external circumferential surface of the intermediate transfer belt 16 between the back-up roll 3 and the driving roll 11, a discharging roll (not shown) for discharging the external circumferential surface is provided.

In addition, a paper tray 7 for stocking recording paper is provided at the bottom of the image forming device, and paper can be supplied so as to pass through a pressure-contacting part between the back-up roll 3 and the secondary transfer roll 5 constituting a secondary transfer portion from the paper tray 7 via a paper path 6. A recording paper which has passed through this pressure-contacting part can be conveyed by a conveying means (not shown) so as to pass through a pressure-contacting part of a pair of fixing rolls 2 and, finally, can be ejected outside of the image forming device.

Next, an image forming method using the image forming device of FIG. 1 will be explained. A toner image is formed at every developing unit, and the surfaces of the photoreceptors 9 rotating counter-clockwise are uniformly electrified with electrifying rolls 13, after which latent images are formed on the surfaces of the electrified photoreceptors 9 with a laser-generating device 8 (exposing device), and then the latent images are developed with a developer supplied from the developing devices 15 to form toner images, and the toner images brought to a pressure-contacting part between the primary transfer rolls 10 and the photoreceptors 9 are transferred onto the external circumferential surface of the intermediate transfer belt 16 rotating in the direction of arrow E. Toner and refuse adhered to the surface of the photoreceptors 9 after transfer of the toner images are cleaned with photoreceptor cleaners 14, ready for formation of the next toner image.

Toner images of each color developed at every developing unit are successively superimposed on the external circumferential surface of the intermediate transfer belt 16 so as to correspond to image information, and are delivered thus to the secondary transfer portion where they are transferred onto a surface of a recording paper conveyed from paper tray 7 via paper path 6, with the secondary transfer roll 5. A recording paper onto which a toner image has been transferred is further fixed by heating under pressure upon passing through a pressure-contacting part of the pair of fixing rolls 2 constituting a fixing portion and, after formation of an image on a recording medium surface, it is discharged outside the image forming device.

An intermediate transfer belt which has passed through a secondary transfer portion proceeds further in the direction of arrow E, the external circumferential surface thereof is electricity-removed with a discharging roll (not shown), and the external circumferential surface is cleaned with a transfer cleaner 12, ready for transfer of a next toner image.

In the above-explained image forming device, an intermediate transfer belt 16 has a prescribed surface resistivity. In addition, in the invention, it is preferable that a photoreceptor 9 (image bearing body) has a prescribed surface charge density. Details will be explained below. Reference numbers are omitted in the following description.

First, an image bearing body (photoreceptor) will be explained. Conventionally known image bearing bodies can be used in the invention and examples of a photosensitive layer thereof include conventionally-known ones such as those made from an organic system or those made from amorphous silicon. When the image bearing body is cylindrical, this can be obtained by a known process such as extrusion and molding of aluminum or an aluminum alloy, followed by surface processing. A typical example of an image bearing body has a structure in which an undercoating layer and a photosensitive layer (charge-generating layer, charge transporting layer) are successively provided on an electrical conductive support. The photosensitive layer may be a monolayered structure, or a function-separated type laminated structure. Alternatively, a belt-type image bearing body may be used.

An image bearing body has a surface charge density at electrification of preferably about $8\times10^{-4}$ C/m$^2$ or higher, more preferably about $10\times10^{-4}$ C/m$^2$ or higher, and yet more preferably about $25\times10^{-4}$ C/m$^2$ or higher. A preferable upper limit is about $40\times10^{-4}$ C/m$^2$. When this surface charge density is less than about $8\times10^{-4}$ C/m$^2$, the photoreceptor charge is lost by discharge from the intermediate transfer belt generated by primary transfer, and in some cases the lost part produces an image quality defect in the form of a discharge mark.

The surface charge density is determined by the dielectric constant of a photoreceptor, the film thickness of a photoreceptor, and the electrification potential. Examples of methods of increasing the surface charge density include the use of a material having a high specific dielectric constant (e.g. binder resin), use of a high electrification set potential, and reduction in film thickness (e.g. film thickness of a charge transporting layer). Surface charge density can be adjusted by one of these methods or a combination thereof.

A surface charge density $\sigma$ is given by the following equation, given that the specific dielectric constant of an image bearing body is $\epsilon_r$, the vacuum dielectric constant is $\epsilon_0$, the electrification potential of the image bearing body is $V_0$, and the film thickness of the image bearing body is d. These condition values are values at a normal temperature and a normal humidity (22° C., 55% RH).

$$\sigma=\epsilon_r\epsilon_0 V_0/d$$

The specific dielectric constant of an image bearing body can be measured with a general LCR meter. Specifically, a circular gold electrode having a diameter of 10 mm is deposited on an image bearing body surface, and a specific dielectric constant can be measured with HP4274A (trade name, manufactured by Nippon Hewlett Packard). Alternatively, the specific dielectric constant may be obtained from the electrification property of a photoreceptor. Specifically, when the electrification initial voltage is $V_0$, the volume resistivity of an image bearing body is $\rho$, the specific dielectric constant of an image bearing body is $\epsilon_r$, the vacuum dielectric constant is $\epsilon_0$ ($8.85\times10^{-12}$ F/m), and time is t, the electrification voltage V at a time t is given by the following equation. Further, $\rho$ is obtained from the relationship between a current value (deep current) and a voltage during application of an electrification voltage, and $\epsilon_1\epsilon_0$ can be obtained from the change in V relative to time (t).

$$V = V_0 e^{-\frac{t}{\varepsilon_r \varepsilon_0 \rho}}$$

On the other hand, a film thickness of an image bearing body can be measured using a general eddy current format film thickness meter. Specifically, for example, Fischer scope (trade name: MMS, manufactured by FISCHER) is used.

In general, since an undercoating layer of an image bearing body is an electrically conductive layer, and a film thickness of a charge-generating layer is as small as can be neglected, a reference value of a material constituting a charge transporting layer (e.g. binder resin, polymer charge transporting material etc.) may be used in place of a specific dielectric constant of an image bearing body, and, a film thickness of a charge transporting layer may be used in place of a film thickness of an image bearing body.

Then, each feature of an image bearing body will be explained in detail. First, as an electrically conductive support, the known material such as a drum-like, sheet-like or plate-like entity electrical conductive-treated by depositing a metal such as aluminum, copper, gold, silver, platinum, palladium, titanium, nickel-chromium, stainless steel, and copper-indium on a metal drum or sheet such as aluminum, copper, iron, stainless, zinc, and nickel, a paper, a plastic or a glass, or depositing an electrically conductive metal compound such as indium oxide, and tin oxide, on the aforementioned material, or laminating a metal foil on the aforementioned material, or dispersing carbon black, indium oxide, tin oxide-antimony oxide powder, metal powder, or copper iodide in a binder resin, and coating the dispersion on the aforementioned material can be used.

When a metal pipe substrate is used, a surface thereof may either be left as a plain tube or have been subjected to a treatment such as specular cutting, etching, anodic oxidation, crude cutting, centerless cutting, sandblast, and wet horning in advance.

Examples of the electrically conductive support further include an electrically conductive plastic substrate obtained by dispersing electrically conductive fine particles such as carbon black particles, metal fine powders, or metal oxide fine particles in a binder resin, and forming the dispersion into a pipe-shape with a centrifugation molding or extrusion molding machine.

Aluminum may be used as an electrically conductive support in an appropriate shape such as a drum, a sheet, or a plate, being not limiting thereby. In addition, anodic oxidation treatment, boehmite treatment, and horning treatment may be performed for the purpose of injection suppression, adherability improvement, and interference fringe prevention.

An undercoating layer (intermediate layer) may be formed between a substrate and a photosensitive layer in accordance with necessity. Examples of a material to be used include an organic zirconium compound such as a zirconium chelate compound, a zirconium alkoxide compound, or a zirconium coupling agent, an organic titanium compound such as a titanium chelate compound, a titanium alkoxide compound, or a titanate coupling agent, an organic aluminum compound such as an aluminum chelate compound and an aluminum coupling agent. Examples thereof further include an organic metal compound such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, or an aluminum zirconium alkoxide compound. Particularly, an organic zirconium compound, an organic titanyl compound, and an organic aluminum compound are preferably used since they have a low residual potential, and exhibits better electrophotography property. In addition, a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3,4-epoxycyclohexyltrimethoxysilane may be contained, and used. Further, the known binder resin such as polyvinyl alcohol, polyvinyl methyl ether, poly-N-vinylimidazole, polyethylene oxide, ethylcellulose, methylcellulose, ethylene-acrylic acid copolymer, polyamide, polyimide, casein, gelatin, polyethylene, polyester, phenol resin, vinyl chloride-vinyl acetate copolymer, epoxy resin, polyvinylpyrrolidone, polyvinylpyridine, polyurethane, polyglutamic acid, or polyacrylic acid which have been used in an undercoating layer may be used. A ratio of mixing them may be appropriately set, if necessary. In addition, an electron transporting pigment may be used in a mixed/dispersed state in an undercoating layer.

It is generally suitable that a thickness of an undercoating layer is in a range of about 0.1 to 30 μm, preferably about 0.2 to 25 μm. Examples of a coating method used when an undercoating layer is provided include conventional methods such as a blade coating method, a Meyer bar coating method, a spray coating method, a dipping coating method, a bead coating method, an air knife coating method, or a curtain coating method. The undercoating layer is obtained by coating and drying a coated material, and usually, drying is performed by evaporating a solvent at a temperature at which the coated material can form a film. In particular, since a defect hiding force of a substrate easily becomes insufficient in a substrate which has been subjected to acidic solution treatment or boehmite treatment, it is preferable to form an intermediate layer thereto.

Next, a charge-generating layer will be explained. As a charge-generating material, any known charge-generating materials such as an azo pigment such as bisazo or trisazo, a fused ring aromatic pigment such as dibromoanthoanthrone, a perylene pigment, a pyrrolopyrrole pigment or a phthalocyanine pigment can be used. Particularly, metal and non-metal phthalocyanine pigments are preferable. Among these, hydroxygalliumphthalocyanines disclosed in JP-A Nos. 5-263007 and 5-279591, chlorogalliumphthalocyanines disclosed in JP-A No. 5-98181, dichlorotinphthalocyanines disclosed in JP-A Nos. 5-140472 and 5-140473, and titanylphthalocyanines disclosed in JP-A Nos. 4-189873 and 5-43813 are particularly preferable.

A binder resin used in the charge-generating layer can be selected from a wide range of insulating resins. Examples of a preferable resin include insulating resins such as a polyvinylbutyral resin, a polyacrylate resin, a polycarbonate resin, a polyester resin, a phenoxy resin, a vinyl chloride-vinyl acetate copolymer, a polyamide resin, an acryl resin, a polyacrylamide resin, a polyvinylpyridine resin, a cellulose resin, a urethane resin, an epoxy resin, a polyvinyl alcohol resin, or a polyvinylpyrrolidone resin, being not limited thereby. Alternatively, the binder resin may be selected from organic photoconductive polymers such as poly-N-vinylcarbozole, polyvinylanthracene, polyvinylpyrene or polysilane. These binder resins can be used alone, or in combination of two or more kinds thereof by mixing.

A blending ratio (weight ratio) of the charge-generating material and the binder resin is preferably in a range of about 10:1 to 1:10. As a method of dispersing them, a conventional method such as a ball mill dispersing method, an attritor dispersing method, and a sand mill dispersing method can be used and, thereupon, condition under which a crystal type of a charge-generating material is not changed by dispersing is necessary. Upon dispersing, it is effective to make particles have a particle diameter of about 0.5 μm or smaller, preferably about 0.3 μm or smaller, further preferably about 0.15 μm or smaller.

As a solvent used in the dispersing, conventional organic solvents such as methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, chlorobenzene, or toluene can be used alone or in combination of two or more kinds thereof by mixing. It is generally suitable that a thickness of a charge-generating layer used in the invention is in a range of about 0.1 to 5 μm, preferably about 0.2 to 2.0 μm. As a method of coating a charge-generating layer, a conventional method such as a blade coating method, a Meyer bar coating method, a spray coating method, a dipping coating method, a bead coating method, an air knife coating method, or a curtain coating method can be used.

Then, a charge transporting layer will be explained. The charge transporting layer is formed so as to include a charge transporting material and a binder resin, or is formed so as to include a polymer charge transporting material.

Examples of a charge transporting material include electron transporting compounds such as a quinone-based compound such as p-benzoquinone, chloranil, bromanyl or anthraquinone, a tetracyanoquinodimethane-based compound, a fluorenone compound such as 2,4,7-trinitrofluorenone, a xanthon-based compound, a benzophenone-based compound, a cyanovinyl-based compound or an ethylene-based compound, and hole transporting compounds such as a triarylamine-based compound, a benzidine-based compound, an arylalkane-based compound, an aryl-substituted ethylene-based compound, a stilbene-based compound, an anthracene-based compound or a hydrazone-based compound. These charge transporting materials can be used alone, or by mixing two or more kinds, being not limiting.

As a charge transporting material, a material having the following structure is preferable from a viewpoint of mobility.

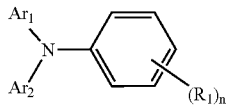

In the formula, $R_1$ represents a hydrogen atom or a methyl group. n represents an integer of 1 or 2. $Ar_1$ and $Ar_2$ represent an aryl group which may be unsubstituted or substituted with a substituent selected from the group consisting of a halogen atom, an alkyl group of having 1 to 5 carbon atoms, an alkoxy group having 1 to 5 carbon atoms, and a substituted amino group substituted with an alkyl group having 1 to 3 carbon atoms.

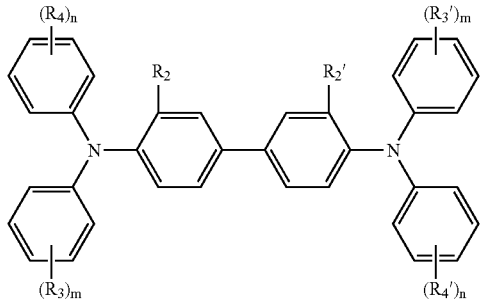

In the formula, $R_2$ and $R_{2'}$ may be the same or different, and each represent a hydrogen atom, a halogen atom, an alkyl group having 1 to 5 carbon atoms, or an alkoxy group having 1 to 5 carbon atoms. $R_3$, $R_{3'}$, $R_4$ and $R_{4'}$ may be the same or different, and each represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, or —$C(R_5)$=$C(R_6)(R_7)$, and $R_5$, $R_6$ and $R_7$ each represent a hydrogen atom, a substituted or unsubstituted alkyl group, or a substituted or unsubstituted aryl group. m and n are an integer of 0 to 2.

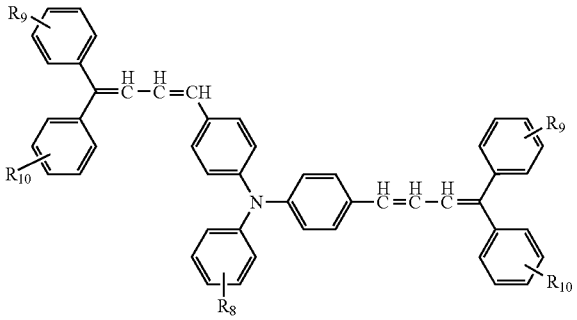

In the formula, $R_8$ represents a hydrogen atom, an alkyl group having 1 to 5 carbon atoms, an alkoxy group having 1 to 5 carbon atoms, a substituted or unsubstituetd aryl group, or —CH=CH—CH=$C(Ar)_2$. Ar represents a substituted or unsubstituted aryl group. $R_9$ and $R_{10}$ may be the same or different, and represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group.

A binder resin used in a charge transporting layer preferably has a specific dielectric constant in a range of about 2 to 5. Specific examples of the binder resin include polymer charge transporting materials such as a polycarbonate resin, a polyester resin, a methacryl resin, an acryl resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole or polysilane, as well as a polyester-based polymer charge transporting material shown in JP-A Nos. 8-176293 and 8-208820. These binder resins can be used alone or in combination of two or more thereof by mixing. It is preferable that a blending ratio (weight ratio) of a charge transporting material and a binder resin is in a range of about 10:1 to 1:5.

Alternatively, a polymer charge transporting material may be used singly. Examples of the polymer charge transporting material include poly-N-vinylcarbazole and polysilane, and particularly preferable examples thereof is a polyester-based polymer charge transporting material shown in JP-A Nos. 8-176293 and 8-208820 since they have high charge transporting property. A polymer charge transporting material may be mixed with the aforementioned binder resin.

It is generally suitable that a thickness of a charge transporting layer is in a range of about 5 to 50 μm, preferably in a range of about 10 to 35 μm. Examples of a coating method include a blade coating method, a Meyer bar coating method, a spray coating method, a dipping coating method, a bead coating method, an air knife coating method and a curtain coating method.

Examples of a solvent used when the charge transporting layer is provided include conventional organic solvents such as aromatic hydrocarbons such as toluene, xylene or chlorobenzene, ketones such as acetone and 2-butanone, or cyclic or straight ethers such as tetrahydrofuran or ethyl ether. These solvents can be used alone or in combination of two or more thereof by mixing.

In addition, for the purpose of preventing deterioration of a photosensitive layer due to ozone and oxidizing gas produced during electrification, light or heat, an additive such as an antioxidant, a light stabilizer, or a heat stabilizer can be added to the photosensitive layer. Examples of the antioxidant include hindered phenol, hindered amine, paraphenylenediamine, arylalkane, hydroquinone, spirocoumarin, and spiroindanone, derivatives thereof, an organic sulfur compound, and an organic phosphorus compound.

Examples of a light stabilizer include derivatives of benzophenone, benzotriazole, dithiocarbamate, and tetramethylpiperidine. In addition, for the purpose of improving sensitivity, reducing a residual potential, and reducing fatigue upon use, at least one kind of electron acceptor substance may be contained. Examples of the usable electron acceptor substance include succinic acid anhydride, maleic acid anhydride, dibromomaleic acid anhydride, phthalic acid anhydride, tetrabromophthalic acid anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, fluorenone benzene derivatives, quinone benzene derivatives, and benzene derivatives having an electron withdrawing substituent such as Cl, CN, and $NO_2$ are particularly preferable.

Next, an intermediate transfer belt will be explained. The intermediate transfer belt is constituted, for example, of a substrate containing an electrically conducting agent. If necessary, a functional layer such as a removing layer may be provided on a substrate surface (belt surface).

The intermediate transfer belt is characterized in that an absolute value of a difference between a common logarithm of a surface resistivity 10 seconds after voltage application and a common logarithm value of a surface resistivity 30 milliseconds after voltage application (hereinafter, referred to as "difference in common logarithm value of surface resistivity in the invention" in some cases) is about 0.2 (Log Ω/□) or less, preferably about 0.15 (Log Ω/□) or less, more preferably about 0.10 (Log Ω/□) or less, and most ideally 0 (that is, both resistance values are the same). When an absolute value of the difference in a common logarithm value of a surface resistivity in the invention exceeds about 0.2, a problem of unacceptable transfer, an image unevenness in image concentration, and a narrow transfer current effective range is caused when high speed printing is performed.

The inventors conducted intensive research and, as a result, found that the occurrence of unevenness in image concentration in image formation is derived from the belt effective resistivity at a primary transfer point. That is, previously, the electric resistivity of the intermediate transfer belt was managed by the surface resistivity 10 seconds after primary transfer and the volume resistivity 30 seconds after primary transfer. However, a time for which the electric field is actually applied in primary transfer in an actual image forming device has been drastically shortened. The electric resistance when the electric field is applied for a short time is associated with actual transfer. However, electric resistance exhibits time dependency, and shows a rise of resistance value with the electric field application time. In particular, in a high speed machine which performs high speed printing, the electric field is applied for a short time, and the difference in the rise of belt resistance is highlighted, leading to unevenness in image concentration and thus in image quality. In addition, since electric resistance at this time is offset as part of the device structure, this is associated with the surface resistance rather than with the volume resistance as was previously thought. For this reason, by reducing the rise of belt surface resistivity, that is, by making the absolute value of a difference in a common logarithm of surface resistivity in the invention 0.2 (Log Ω/□) or less, unevenness in image concentration generated in a high speed machine is suppressed and, at the same time, this can be applied to printing speeds other than high speed printing and, thus, an intermediate transfer belt having a wide range of device applications is obtained.

In addition, the common logarithm value of a 30 msec surface resistivity is preferably in a range of about 9 to 13 (Log Ω/□), more preferably in a range of about 10 to 12 (Log Ω/□), and further preferably in a range of about 10.3 to 11.8 (Log Ω/□). When this common logarithm value of the surface resistivity is larger than about 13 (Log Ω/□), a recording medium and an intermediate transfer body are electrostatically adsorbed at secondary transfer, and a recording medium cannot be peeled off, which is not preferable. On the other hand, when the common logarithm value of a surface resistivity is smaller than about 9 Log Ω/□, the retaining force for a toner image which has been primarily transferred onto an intermediate transfer belt is deficient, and granularity of image quality and image disturbance are generated.

The surface resistivity can be controlled in the aforementioned range by a kind of electrically conducting agent blended in a substrate and a method of adding the agent (e.g. kneading addition by jet mill), particularly specifically by a kind of carbon black described later and a method of dispersing the carbon black.

Herein, surface resistivity after X seconds refers to a value after X seconds has passed since voltage application. Further, surface resistivity can be measured using a circular electrode (e.g. trade name: UR PROBE of HIRESTA-UP, manufactured by Mitsubishi Chemical CO., Ltd & DAIAINSTRUMENTS CO., Ltd.) according to the known surface resistivity measuring method. A method of measuring surface resistivity will be explained with reference to the drawings. FIG. 2 is a schematic plane view (FIG. 2A) and a schematic cross-sectional view (FIG. 2B) showing one example of a circular electrode. A circular electrode shown in FIG. 2 is provided with a first voltage application electrode A and a plate-like insulating body B. The first voltage application electrode A is provided with a cylindrical electrode part C, and a cylindrical ring-like electrode part D having an internal diameter larger than an external diameter of the cylindrical electrode part C, and which surrounds the cylindrical electrode part C at a constant interval. An intermediate transfer body T is held between the cylindrical electrode part C and the ring-like electrode part D at the first voltage application electrode A, and the plate-like insulating body B, and a voltage V(V) is applied between the cylindrical electrode part C and the ring-like electrode part D at the first voltage application electrode A, and a current I (A) which flows thereupon is measured, and the surface resistivity ρs(Ω/□) of the transfer surface of the intermediate transfer body T can be calculated by the following equation.

Herein, in the following equation (1), d represents an external diameter of a cylindrical electrode part C (mm), and D represents an internal diameter of a ring-like electrode part D (mm).

$$\rho s=\pi\times(D+d)/(D-d)\times(V/I) \quad \text{Equation (1)}$$

A construction of an intermediate transfer belt will be herein explained in detail. A resin material, which is a main component of an intermediate transfer belt of the invention, is not particularly limited. Examples of the resin material include a polyimide resin, a polyamide resin, a polyamide-imide resin, a polyether ether ester resin, a polyarylate resin, a polyester resin, and a polyester resin to which a reinforcing material is added. A material having a high Young's modulus is preferable in that since deformation due to (a stress of a supporting roll, or a cleaning blade) at driving is small, an image defect such as color misregistration is generated with difficulty. In particular, an intermediate transfer belt containing a polyimide resin as a main component is preferable since it has a high Young's modulus.

In the invention, a resin material as a main component refers to that the material is about 50% by weight or more in a total resin. When a polyimide resin is a main component, a ratio of a polyimide resin in a total resin is preferably about 70% by weight or more, more preferably about 90% by weight or more.

Since a polyimide resin is a high Young's modulus material, deformation due to (a stress of a supporting roll, or a cleaning blade) at driving is small. Therefore, an intermediate transfer belt hardly causing an image defect such as color misregistration is obtained by using a polyimide resin as a main component. A polyimide resin is usually obtained as a polyamide acid solution by polymerization-reacting an equivalent mole of tetracarboxylic acid dianhydride or a derivative thereof and a diamine in a solvent. Examples of tetracarboxylic acid dianhydride include a dianhydride represented by the following Formula (I).

Formula (I)

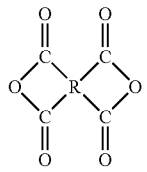

In Formula (I), R is a tetravalent organic group, and is an aromatic group, an aliphatic group, a cyclic aliphatic group, a combination of an aromatic group and an aliphatic group, or a substituted group thereof.

Specific examples of tetracarboxylic acid dianhydride include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylic acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl)sulfonic acid dianhydride, perylene-3,4,9,10-tetracarboxylic acid dianhydride, bis(3,4-dicarboxyphenyl)ether dianhydride, and ethylenetetracarboxylic acid dianhydride.

On the other hand, specific examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl4,4'-biphenyldiamino, benzidine, 3,3'-dimethylbenzidine, 3,3'-dimethoxybenzidine, 4,4'-diaminodiphenylsulfone, 4,4'-diaminodiphenylpropane, 2,4-bis(β-aminotertiarybutyl)toluene, bis(p-β-aminotertiarybutyl phenyl)ether, bis(p-β-methyl-δ-aminophenyl)benzene, bis-p-(1,1-dimethyl-5-amino-bentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

Preferable examples of a solvent when tetracarboxylic acid dianhydride and diamine are polymerization-reacted include a polar solvent (organic polar solvent) from a viewpoint of solubility. As a polar solvent, N,N-dialkylamides are preferable, and examples thereof include N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylenesulfone, and dimethyltetramethylenesulfone which have a low molecular weight. These can be used alone or in combination of plurality of them.

It is preferable that the intermediate transfer belt is constituted of a substrate comprising a polyimide resin in which an electrically conducting agent is dispersed. As this electrically conducting agent, an electrically conductive or semi-electrically conductive fine powder can be used. As far as a desired electric resistance can be stably obtained, electrical conductivity is not limited. Examples of the electrically conducting agent include carbon black such as ketchen black or acetylene black, metal such as aluminum or nickel, metal oxide compound such as tin oxide, and potassium titanate. These electrically conducting agents may be used alone, or may be used in combination, and it is preferable that carbon black is contained since it is advantageous in view of cost. Further preferably, acidic carbon black having a pH of 5 or lower is contained since it gives better dispersion stability, can reduce a resistance scatter of an intermediate transfer body, reduces electric field dependency, and gives stability of an electric resistance with time in which electric field concentration due to a transfer voltage occurs with difficulty.

Acidic carbon black can be prepared by oxidation-treating carbon black so as to impart a carboxyl group, a quinone group, a lactone group, or a hydroxy group to a surface thereof. This oxidation treatment can be performed by, for example, an air oxidizing method of contacting carbon black with the air to react them under the high temperature atmosphere, a method of reacting with nitrogen oxide or ozone under a normal temperature, or a method of performing air oxidation under a high temperature and, thereafter, ozone oxidation under a low temperature. Specifically, acidic carbon black can be prepared by a contact method. Examples of this contact method include a channel method and a gas black method. Alternatively, acidic carbon black may be prepared by a furnace black method using a gas or an oil as a raw material. If necessary, after these treatments, liquid phase oxidation treatment with nitric acid may be performed. Acidic carbon black can be prepared by a contact method, however, acidic carbon black is usually prepared by a closed furnace method. In the furnace method, usually, only carbon black having a high pH and a low volatile matter is prepared, and this may be subjected to the aforementioned liquid phase acid treatment to adjust a pH. For this reason, carbon black which is obtained by a furnace method and whose pH has been adjusted to 5 or smaller by post-step treatment is included in examples of carbon black which is suitably used in the invention.

A pH value of acidic carbon black is preferably in a range of about 5.0 or smaller, preferably in a range of about 4.5 or smaller, more preferably in a range of about 4.0 or smaller. Since acidic carbon black having a pH of about 5.0 or smaller has an oxygen-containing functional group such as a carboxyl group, a hydroxy group, a quinone group, or a lactone group on a surface, dispersibility in a resin is better, better dispersion stability is obtained, and a resistance scatter of an intermediate transfer belt can be reduced and, at the same time, electric field dependency is reduced, and electric field concentration due to a transfer voltage is caused with difficulty.

A pH of acidic carbon black can be obtained by preparing an aqueous suspension of carbon black, and measuring with a glass electrode. A pH of acidic carbon black can be appropriately adjusted through conditions such as treatment temperature or treatment time length at an oxidation treatment.

It is suitable that acidic carbon black contains about 1 to 25%, preferably about 2 to 20%, more preferably about 3.5 to 15% by weight of a volatile matter. When a volatile matter is less than about 1%, the effect of an oxygen-containing functional group adhered to a surface is abolished, and dispersibility in a binder resin is reduced in some cases. On the other hand, when a volatile matter is greater than about 25%, upon dispersing in a binder resin, a volatile matter is degraded, or water adsorbed by an oxygen-containing functional group on a surface is increased, thus, a problem arises that appearance of the resulting molded article is deteriorated, in some cases. Therefore, by adjusting a volatile matter in the aforementioned range, dispersing in a binder resin can be made to be better. This volatile matter can be obtained from a ratio of an organic volatile component (carboxyl group, hydroxy group, quinone group, lactone group etc.) which comes out when carbon black is heated at 950° C. for 7 minutes.

In the intermediate transfer belt of the invention, two or more kinds of carbon blacks may be contained. Thereupon, it is preferable that these carbon blacks have substantially different electrical conductivities. Preferable examples include a combination of carbon blacks having different physical properties such as a specific surface area by a BET method utilizing a DBP oil absorbing amount, or nitrogen adsorption. Like this, when two or more kinds of carbon blacks having different electrical conductivities are added, for example, a surface resistivity can be adjusted by adding carbon black having a low electric conductivity after carbon black manifesting high electric conductivity is preferentially added. Like this, also when two or more kinds of carbon blacks are contained, mixing and dispersing of both carbon blacks can be enhanced by using acidic carbon black in at least one kind of them.

Specific examples of the acidic carbon black include RINTEX® 150T (pH: 4.5, volatility: 10.0%), SPECIAL BLACK® 350 (pH: 3.5, volatility: 2.2%), SPECIAL BLACK® 100 (pH: 3.3, volatility: 2.2%), SPECIAL BLACK® 250 (pH: 3.1, volatility: 2.0%), SPECIAL BLACK® 5 (pH: 3.0, volatility: 15.0%), SPECIAL BLACK® 4 (pH: 3.0, volatility: 14.0%), SPECIAL BLACK® 4A (pH: 3.0, volatility: 14.0%), SPECIAL BLACK® 550 (pH: 2.8, volatility: 2.5%), SPECIAL BLACK® 6 (pH: 2.5, volatility: 18.0%), SPECIAL BLACK® FW200 (pH: 2.5, volatility: 20.0%), COLOUR BLACK® FW2 (pH: 2.5, volatility: 16.5%), and COLOUR BLACK® FW2V (pH: 4.5, volatility: 16.5%) (all manufactured by Degussa); and MONARCH® 1000 (pH: 2.5, volatility: 9.5%), MONARCH® 1300 (pH: 2.5, volatility: 9.5%), MONARCH® 1400 (pH: 2.5, volatility: 9.0%), MOGUL® L (pH: 2.5, volatility: 5.0%), and REGAL® 400R (pH: 4.0, volatility: 3.5%) (all manufactured by Cabot Corporation).

Carbon black to be used may have been purified. Purification is to remove impurities which have been mixed in a manufacturing step, impurities such as a residual oxidizing agent, treating agent and byproduct, and other inorganic impurities or organic impurities. Examples include a method of removing impurities by treatment of heating at a high temperature of around 500 to 1000° C. in an inert gas or in vacuum, treatment with an organic solvent processing such as carbon disulfide and toluene, and mixing of water slurry, and mixing treatment in an aqueous organic acid solution. Purification is not limited to them as far as carbon black can be purified. However, powder heating treatment is difficult in handling in a manufacturing step, and there is a problem that much energy is employed. Treatment mainly using organic solvent treatment or water is preferable as a purification method. In particular, from a viewpoint of safety, a treating method mainly using water is preferable. Particularly, in order to prevent mixing of impurities, it is preferable to use water such as ion-exchanged water, ultrapure water, distilled water, and ultrafiltered water.

Since acidic carbon black has better dispersibility in a resin composition due to the effect of an oxygen-containing functional group present on a surface as described above, as compared with general carbon black, it is preferable to increase an addition amount as an electrically conductive fine powder. Thereby, since an amount of carbon black in an intermediate transfer belt is increased, the effect of use of acidic carbon black that an in plane scatter of the electric resistance value can be suppressed, can be maximally exerted.

By inclusion of acidic carbon black at about 10 to 30 wt %, the effect of acidic carbon black is exerted whereby in-plane scattering of the surface resistivity of an intermediate transfer belt is suppressed. When the content is less than about 10 wt %, the uniformity of electric resistance is reduced, and in-plane scattering and electric field dependency of surface resistivity are increased. On the other hand, when the content exceeds about 30 wt %, a desired resistance value is obtained with difficulty. Further, by inclusion of acidic carbon black at about 18 to 30 wt %, the effect can be exerted maximally, and in-plane scattering and electric field dependency of surface resistivity can be remarkably reduced.

Next, an example of preparation of an intermediate transfer belt by using a polyamide acid solution in which carbon black as an electrically conducting agent is dispersed will be listed, but the invention is not limited to the examples.

First, purified carbon black is prepared, and is dispersed in an organic polar solvent (e.g. N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylenesulfone, dimethyltetramethylenesulfone etc.). As a dispersing method, a method of performing pre-stirring and, thereafter, dispersing carbon black with a dispersing machine or a homogenizer is preferable. In a dispersing method, any of a format of using a medium, and a format of not using a medium can be used. In the case of the former, since mixing of a fine medium reduces the effect of carbon black purification as in a method of purifying carbon black, a medium free dispersing method not using a medium is preferable. In particular, a jet mill is preferable in that a high viscosity solution can be uniformly dispersed, and a difference in a common logarithm value of a surface resistivity in the invention can be more reduced.

For dispersing carbon black with a jet mill, a method using a collision pressure of 150 about MPa or larger is preferable. In addition, a treating time is not particularly limited, but it is preferably in a range of about once to 10 times.

The diamine component and the acid anhydride component are dissolved in the previously obtained carbon black dispersion, and this is polymerized to prepare a polyamide acid solution in which carbon black is dispersed. Thereupon, a monomer concentration (concentration of diamine component and acid anhydride component in solvent) is set by various conditions, and about 5 to 30% by weight is preferable. In addition, a reaction temperature is set at preferably 80° C. or lower, particularly preferably about 5 to 50° C., and a reaction time is about 5 to 10 hours.

Since a polyamide acid solution in which carbon black is dispersed is a high viscosity solution, an air bubble mixed during preparation is not naturally escaped. Therefore a defect such as projection, recess or a hole of a belt due to an air bubble occurs by coating. For this reason, defoaming is desirably performed. It is preferable to perform defoaming immediately before coating, if possible.

Alternatively, a method which includes directly adding carbon black to a polyamide solution, performing dispersing treatment, and diluting with an organic polar solvent, followed by mixing, may be used. This method has a difference in preparation of a polyamide acid solution, however, a mixing and imidation step therein may be performed in the same manner as that described above. In addition, the aforementioned method and condition may be used as dispersing condition.

When a seamless belt is formed as the intermediate transfer belt of the invention, a formation of the seamless belt may be performed by an appropriate method according to conventional methods such as a method having developing a polyamide acid solution in a ring-like by an appropriate manner such as immersing the solution in an external circumferential surface of a cylindrical mold, coating the solution on an internal circumferential surface and further centrifuging this, or filling the solution into an injection mold, drying the developing layer to make a film to mold into a belt shape, heat-treating the molded article to convert polyamide acid into imide, and recovering this from a mold (JP-A Nos. 61-95361, 64-22514, and 3-180309). Upon formation of the seamless belt, a mold can be treated to be releasable.

For conversion into imide, treatment at a high temperature of about 200° C. or higher is general. At about 200° C. of lower, sufficient imide conversion is not obtained. On the other hand, high temperature treatment is advantageous for imide conversion, and stable property is obtained. However, since heat energy is used, a heat efficiency is worse and a cost is increased, therefore, it is necessary to determine a heat-treating temperature in view of property and productivity of an intermediate transfer body.

The intermediate transfer belt can be thus prepared.

The volume resistivity of the intermediate transfer belt is not particularly limited. A common logarithm value of the volume resistivity is preferably in a range of about 8 to 13 (Log Ωcm). When the common logarithm value of the volume resistivity is less than about 8 (Log Ωcm), since the electrostatic force of holding the a charge of an unfixed toner image transferred onto an intermediate transfer belt from an image bearing body becomes weakened, toner is flown to the surroundings of an image by an electrostatic repulsive force between toners, or a fringe electric field near an image edge, and in some cases an image is formed with a large amount of noise. On the other hand, when the normal logarithm value of the volume resistivity is greater than about 13 (Log Ωcm), since a charge holding force is great, the surface of an intermediate transfer body is electrified in the transfer electric field at primary transfer and, therefore, a discharging mechanism becomes necessary in some cases.

Volume resistivity can be measured by the same method as that for surface resistivity. When measuring volume resistivity, the circular electrode shown in FIG. 2 is provided with a second voltage application electrode B in place of the plate-like insulating body used in measurement of surface resistivity. A current I (A) which flows between a cylindrical electrode part C and a second voltage application electrode B upon application of a voltage V (V) is measured, and the volume resistivity ρv (Ωcm) of an intermediate transfer belt T can be calculated. Herein, in the following equation (2), t represents the thickness of an intermediate transfer belt T.

$$\rho v=\pi d^2/4T\times(V/I) \qquad \text{Equation (2)}$$

In addition, the common logarithm value of the volume resistivity can be controlled by the kind and addition amount of the electrically conducting agent blended in the substrate, particularly and specifically, carbon black, which is described above.

A Young's modulus of the intermediate transfer belt is preferably about 2000 MPa or larger, more preferably in a range of about 3,500 MPa or larger, further preferably in a range of not smaller than about 5,000 MPa and not larger than about 10,000. When high speed printing is performed, deformation can be reduced due to a high Young's modulus, occurrence of image disturbance is suppressed and, particularly, occurrence of a spot-like defect at primary transfer can be prevented.

The present inventors intensively studied and, as a result, found that a spot-like defect leads to discharge in a gap produced between a belt and a photoreceptor, or between a belt and a BTR (transfer roll), and this gives a charge history to a photoreceptor. A cause of a gap occurs in a fine gap such as vibration or flapping of a belt due to conveyance of a belt at a high speed, and it is difficult to avoid by belt tension adjustment, or an angle of each attachment member. In order to avoid this problem, it is necessary to improve attitude of a belt, and it was revealed that the problem is avoided by increasing a Young's modulus of a belt. That is, a defect is generated by discharge produced with an intermediate transfer belt and, particularly when an intermediate transfer belt is conveyed at a high speed, this is a problem specific in high speed printing exhibiting a correlation only with a Young's modulus of an intermediate transfer belt.

A Young's modulus E can be calculated based on the following equation (3) by measuring a force ΔS exerted on a unit cross-sectional area and an elongation Δa at a unit length.

$$E=\Delta S/\Delta a \qquad \text{Equation(3)}$$

Herein, ΔS is represented by ΔS=F/(w×t) based on a load F, a film thickness t of a sample, and a sample width w. Δa is represented by Δa=ΔL/L based on a sample standard length L, and a sample elongation at load application ΔL. The thickness of an intermediate transfer belt can be measured using a general contact-type or non-contact-type film thickness meter. In the invention, an eddy current-type film thickness meter (trade name: CTR-1500E, manufactured by Sanko Electronic) was used. A Young's modulus can be measured using a general commercially available tensile tester. In the invention, a tensile tester (trade name: MODEL-1605N, manufactured by AIKO Engineering) was used.

The total thickness of an intermediate transfer belt is preferably in a range of about 0.05 to 0.5 mm, more preferably in a range of about 0.06 to 0.30 mm, and further preferably in a range of about 0.06 to 0.15 mm. When the total thickness of a belt is less than about 0.05 mm, the necessary mechanical properties of the intermediate transfer belt cannot be satisfied in some cases. When the total thickness of a belt exceeds about 0.5 mm, the problem arises that the stress on a belt surface is concentrated due to deformation at a roll bending portion, and in some cases cracks are generated on a surface layer.

The surface micro hardness of a transfer surface of an intermediate transfer belt is preferably about 30 or smaller, more preferably about 25 or smaller. The surface micro hardness can be obtained by a method of measuring what an extent an indenter has penetrated into a sample, rather than by a method of obtaining a diagonal line length of a recess as with Vickers hardness, which is widely used in measuring the hardness of a metal material. Taking a sample load to be P (mN) and a penetration amount (indentation depth) of an indenter into a sample to be D (μm), a surface micro hardness DH is defined by the following equation.

$$DH=\alpha P/D^2$$

Herein, α is a constant depending on the shape of the indenter. When the indenter used is a triangular pyramid indenter, α is 3.8584.

This surface micro hardness is a hardness obtained from a load in a process of indenting an indenter, and an indentation depth, and expresses the strength property of a material in a state including not only plastic deformation but also elastic deformation of a sample. Further, since the measuring area is fine, it is possible to measure a more precise hardness in a range near a toner particle diameter. There is a correlation between a surface micro hardness obtained herein and the occurrence level of a hollow character. When the surface micro hardness of the transfer surface of an intermediate transfer belt is 30 or less, deformation of the transfer surface of the intermediate transfer belt occurs due to the pushing force of a bias roll, in a secondary transfer portion described later. By the deformation, a pushing force concentrated on a toner on an intermediate transfer belt is dispersed. For this reason, since toners are not aggregated, image quality defects such as a hollow character in which a line image is missed do not occur.

The surface micro hardness was obtained by the following method. An intermediate transfer belt was cut into around 5 mm squares, and a small piece was fixed to a glass plate with an instant adhesive. The surface micro hardness of a surface of this sample was measured using an ultra micro hardness tester (trade name: DUH-201S, manufactured by Shimadzu Corporation). Measuring conditions were as follows.

Measuring environment: 22° C., 55% RH
Indenter used: triangle pyramid indenter
Test mode: 3 (soft material test mode)
Test load: 0.70 gf
Load rate: 0.0145 gf/sec
Holding time: 5 sec In a printing device, since printing is performed by transferring a toner image onto an image bearing body, an intermediate transfer belt, and a recording medium in a device, the respective conveying rates determine the printing rate of the device. The above-described intermediate transfer belt suitable in the invention can reduce unevenness in image concentration and spot-like defects even when the conveying rate of the respective members is about 200 mm/sec or greater, and can form a better image even when the conveying rate is less than about 200 mm/sec.

In addition, primary transfer from a photoreceptor to an intermediate transfer belt is an important factor for determining the quality of a final image. It is required that there is no disturbance in the transfer efficiency of primary transfer and the image at transfer, and it is desirable that the transfer current value is high. When the conveying rate of the intermediate transfer belt is about 200 mm/sec or more, the primary transfer current value is preferably about 25 μA or larger, and more preferably about 30 μA or larger.

The main members in an image forming device of the invention will be explained in detail below.

An electrifying means is not particularly limited, and examples include conventionally-known electrifying equipments such as a contact-type electrifying equipment using an electrically conductive or semi-electrically conductive roll, brush, film or rubber blade, a scorotron electrifying equipment utilizing corona discharge, or a corotron electrifying equipment utilizing corona discharge. Among them, a contact-type electrifying equipment is preferable in that electrification compensating ability is excellent. The electrifying means usually applies a direct current to the electrophotography photoreceptor, and an alternate current may be further applied by overlapping.

An exposing means is not particularly limited, and examples include an optical equipment which can expose a surface of the electrophotography photoreceptor into a desired image manner via a polygon mirror by using a light source such as semiconductor laser light, LED (Light Emission Diode) light or liquid crystal shutter light.

A developing means can be appropriately selected in accordance with objects, and examples of the developing means include conventionally-known developing equipments for performing developing by contacting a one-component developer or a two-component developer using a brush or a roller, or without contacting the developer.

Examples of the first transfer means as a transfer means include conventionally-known transfer electrification equipment such as a contact-type transfer electrification equipment using a belt, a roller, a film, or a rubber blade, and a scorotron transfer electrification equipment or a corotron transfer electrification equipment utilizing corona discharge. Among them, a contact-type transfer electrification equipment is preferable in that transfer electrification compensating ability is excellent. In the invention, in addition to the aforementioned transfer electrification equipments, a peeling electrification equipment may be used together.

Similar to the first transfer means, examples of the second transfer means as a transfer means also include a contact-type transfer electrification equipment such as a transfer roller, a scorotron transfer electrification equipment, and a corotron transfer electrification equipment. Among them, a contact-type transfer electrification equipment is preferable as in the first transfer means. When stronger pushing is performed with a contact-type transfer electrification equipment such as a transfer roller, the transferred state of an image can be maintained in the better state. Alternatively, pushing is performed with a contact-type transfer electrification equipment such as a transfer roller at a position of a roller guiding an intermediate transfer body, it becomes possible to perform action of transferring a toner image from an intermediate transfer body onto a material to be transferred in the better state.

Examples of an optical discharging means include a tungsten lamp, and LED, and examples of light quality used in the optical discharging process include white light such as a tungsten lamp, and red light such as LED light. An intensity of irradiation light in the optical discharging process is usually output-set so as to be around a few to about 30-fold an optical amount showing a half exposure sensitivity of an electrophotography photoreceptor.

A fixing means is not particularly limited, and examples include the known fixing equipment such as a thermal roller fixing equipment or an oven fixing equipment. A cleaning means is not particularly limited, and examples thereof include conventionally-known cleaning devices.

EXAMPLES

The present invention will be explained more specifically below by way of Examples, however, each in the Examples do not limit the invention.

Preparation of Photoreceptor

Preparation of Electrically Conductive Support

As an electrically conductive support, a support have a central line average roughness Ra75 of 0.18 μm, that is obtained by subjecting a surface of an ED tube aluminum (84 mmΦ) to roughening treatment so as to by a liquid homing method using an alumina spherical fine powder (volume average particle diameter D50=30 μm), is used.

Formation of Undercoating Layer 4 parts by weight of a polyvinylbutyral resin (trade name: S-LEK BM-S, manufactured by Sekisui Chemical Co., Ltd.) is dissolved in 170 parts by weight of n-butyl alcohol, and a mixture of 30 parts by weight of an organic zirconium compound (acetylacetonezirconium butyrate) and 3 parts by weight of an organic silane compound (γ-aminopropyltrimethoxysilane) is further mixed and stirred therewith to obtain a coating solution for forming an undercoating layer.

The resulting coating solution for forming an undercoating layer is then coated on a surface of the electrically conductive support by an immersion coating method, and curing treatment is performed at 150° C. for 1 hour to form an undercoating layer having a film thickness of 0.9 μm.

Formation of Charge-Generating Layer

A mixture consisting of 3 parts by weight of chlorogalliumphthalocyanine having a diffraction peak at positions of 7.4°, 16.6°, 25.5° and 28.3° in a Bragg angle (2θ±0.2°) of a X-ray diffraction spectrum using Cukα-ray, 2 parts by weight of a vinyl chloride-vinyl acetate copolymer (trade name: VMCH, manufactured by Nippon Unicar Company Ltd.), and 180 parts by weight of butyl acetate is dispersing-treated with a sand mill for 4 hours to obtain a coating solution for forming a charge-generating layer.

The resulting coating solution for forming a charge-generating layer is coated on a surface of the electrically conductive support on which the undercoating layer has been formed by an immersion coating method, and this is dried to form a charge-generating layer having a film thickness of 0.2 μm.

Formation of Charge Transporting Layer

Forty parts by weight of a charge transporting material shown by the following structural formula 40 parts by weight (N,N-bis(3,4-dimethylphenyl)diphenyl-4-amine), and 60 parts by weight of bisphenol Z-type polycarbonate (EUPIRON® Z300, manufactured by Mitsubishi Chemical Co.) are added to 200 parts by weight of tetrahydrofuran to dissolve them to obtain a coating solution for forming a charge transporting layer.

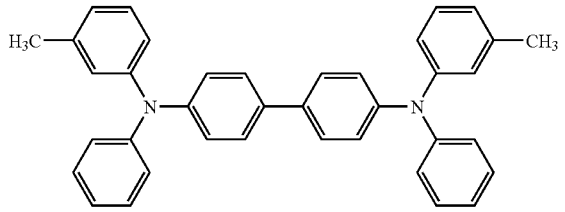

Further, the resulting coating solution for forming a charge transporting layer is coated on a surface of the electrically conductive support on which the undercoating layer and the charge-generating layer has been formed by an immersion coating method, and this is dried at 115° C. for 45 minutes to form a charge transporting layer.

As are described above, a true photoreceptor composed of three layers is prepared. Herein, a charge transporting layer which is formed at a film thickness of 14 μm is designated as photoreceptor A, the layer which is formed at a film thickness of 20 μm is designated as photoreceptor B, and the layer which is formed at a film thickness of 32 μm is designated as photoreceptor C.

A surface charge density is calculated using a specific dielectric constant (2.9) of bisphenol Z-type polycarbonate which is a binder resin of a charge transporting layer.

Preparation of Intermediate Transfer Belt

A NMP solution of polyamide acid (solid matter concentration: 20% by weight) and carbon black shown in Table 1 are dispersing-treated (collision pressure: 150 MPa, treating time: 5 times) with a wet jet mill dispersing machine (trade name: GEANUS PY, manufactured by Geanus) to obtain a carbon black-dispersed polyamide acid solution. This is passed through a stainless 20 μm mesh to remove foreign matters, and carbon black aggregates. Further, vacuum defoaming is performed for 15 minutes while stirring, to prepare a final coating solution.

Then, the resulting final coating solution is coated on a cylindrical mold internal surface (internal diameter 168 mm, length 50 mm, wall thickness 10 mm) through a dispenser so that a thickness became 0.5 mm, this is rotated at 1500 rpm for 15 minutes to obtain a developed layer having a uniform thickness, the hot air at 60° C. is jetted from the outside of a mold for 30 minutes while rotating at 250 rpm, and this is heated at 150° C. for 60 minutes to remove NMP, which is removed from the mold as the semi-cured state. Thereafter, a belt removed from the mold is covered on an iron core, and a temperature is raised to a firing temperature (300° C. to perform imide conversion to obtain a desired polyimide belt (intermediate transfer belt). A thickness of a belt is about 80 μm.

The belts prepared according to compositions shown in Table 1 are designated as belts 1 to 3, respectively.

TABLE 1

| | Belt 1 | Belt 2 | Belt 3 |
|---|---|---|---|
| Polyamide acid moiety | BPDA, ODA (trade name: U IMIDE KX manufactured by Unitika Ltd.) | BPDA, PDA (trade name: U IMIDE TX, manufactured by Unitika Ltd.) | BPDA, ODA (trade name: U IMIDE KX, manufactured by Unitika Ltd.) |
| Carbon black | SB4A (27 parts) | SB4A (24 parts) | SB4A (15 parts) SB250 (15 parts) |

Herein, constitutional components of polyamide acid used and their trade names are described in a column of polyamide acid in Table 1. Abbreviations of the following carbon black are described in a column of carbon black and, as a numerical value in parenthesis, addition amounts (parts by weight) relative to 100 parts by weight of a NMP solution of polyamide acid are described. Details of abbreviations in Table 1 are as follows.

BPDA: biphenyltetracarboxylic acid dianhydride

ODA: oxydianiline

PDA: p-phenylenediamine

SB4A: SPECIAL BLACK® 4A, manufactured by Degussa

SB250: SPECIAL BLACK® 250, manufactured by Degussa

Using a circular electrode (trade name: UR PROBE of HIRESTA-UP, manufactured by Mitsubishi Chemical CO., Ltd.& DAIAINSTRUMENTS CO., Ltd. , in a cylindrical electrode C, external diameter Φ16 mm, internal diameter of ring-like electrode part D Φ30 mm, external diameter of the part Φ40 mm) shown in FIG. 2, a voltage of 100V is applied to each of the resulting polyimide belts under 22° C./55% RH environment, and resistance values 30 msec and 10 sec after application are measured. Common logarithm values of a surface resistivity 30 msec and 10 sec after application are calculated from measured values, and a common logarithm value of a surface resistivity 30 msec after application, and a difference between common logarithm values of a surface resistivity 30 msec and 10 sec after application (10 sec-30 msec) are shown in Table 2.

Examples 1 to 4 Comparative Examples 1 to 5

According to a combination shown in Table 2, the photoreceptor and the intermediate transfer belt are assessed for a discharge mark and an image quality of transfer property using a modified machine of a digital composite machine (trade name: DOCUCENTRE COLOR 2220, manufactured by Fuji Xerox Co., Ltd.) having the same construction as that of FIG. 1. Thereupon, a test is performed at an electrification voltage (photoreceptor surface potential) at three levels of −600V, −700V and −800V according to Table 2. A test is performed at a process speed of two levels of 250 mm/sec and 300 mm/sec. Results are shown in Table 2.

Discharge Mark

A discharge mark is tested under the condition of a primary transfer current of 30 μA when a process speed is 250 mm/sec, and under the condition of a primary transfer current of 35 μA when a process speed is 300 mm/sec, and a discharge mark is determined visually. Criteria of discharge mark determination are as follows:

A: A discharge mark dose not occur.

B: A discharge mark occurs slightly.

C: A big discharge mark occurs.

Transfer Property (Image Density Uniformity)

As transfer property, image density uniformity when transfer property is worsened is determined visually by setting a primary current value at 15 μA when a process speed is 250 mm/sec, and by setting a primary transfer current at 18 μA when a process speed is 300 mm/sec. Criteria of density uniformity determination are as follows:

A: A whole surface density is uniform.

B: There is slight density ununiformity.

C: Density ununiformity is remarkable.

TABLE 2

| | | Surface | Difference between Surface | Photoreceptor | | | Process speed 250 mm/sec | | Process speed 300 mm/sec | |
|---|---|---|---|---|---|---|---|---|---|---|
| | Belt | resistivity after 30 msec (LogΩ/□) | resistivity at 10 sec-30 msec (LogΩ/□) | Photo-receptor kind | surface potential (V) | Photoreceptor charge density (C/m$^2$) | Discharge mark | Image density uniformity | Discharge mark | Image density uniformity |
| Example 1 | Belt 1 | 11.5 | 0.11 | A | −700 | −1.28E-03 | A | A | A | A |
| Example 2 | Belt 1 | 11.5 | 0.11 | B | −800 | −1.03E-03 | A | A | A | A |
| Example 3 | Belt 1 | 11.5 | 0.11 | B | −700 | −8.99E-04 | A | A | B | A |
| Example 4 | Belt 2 | 11.2 | 0.12 | B | −700 | −8.99E-04 | A | A | B | B |
| Comparative Example 1 | Belt 1 | 11.5 | 0.11 | B | −600 | −7.70E-04 | C | A | C | A |

TABLE 2-continued

| | Belt | Surface resistivity after 30 msec (LogΩ/□) | Difference between Surface resistivity at 10 sec-30 msec (LogΩ/□) | Photoreceptor Photo-receptor kind | surface potential (V) | Photoreceptor charge density (C/m$^2$) | Process speed 250 mm/sec Discharge mark | Image density uniformity | Process speed 300 mm/sec Discharge mark | Image density uniformity |
|---|---|---|---|---|---|---|---|---|---|---|
| Comparative Example 2 | Belt 1 | 11.5 | 0.11 | C | −700 | −5.62E-04 | C | A | C | A |
| Comparative Example 3 | Belt 3 | 11.7 | 0.45 | B | −800 | 1.03E 03 | A | C | A | C |
| Comparative Example 4 | Belt 3 | 11.7 | 0.45 | B | −700 | −8.99E-04 | A | C | B | C |
| Comparative Example 5 | Belt 3 | 11.7 | 0.45 | B | −600 | −7.70E-04 | C | C | C | C |

From these results, it is seen that, by increasing a charge density of a photoreceptor surface at electrification by maintaining a difference between a 10 sec surface resistivity and a 30 msec surface resistivity of an intermediate transfer belt at a prescribed value, an excellent image having high density uniformity and causing no defect is obtained even at high speed printing. In addition, it is seen that this effect becomes remarkable when a process speed is increased.

Examples 5 to 7, Comparative Examples 6 to 10

Using a NMP solution of polyamide acid (solid matter concentration: 20 weight %) having a concentration shown in Table 3, each of coating solutions is prepared, and a polyimide belt (intermediate transfer belt) is prepared according to the same manner as that of Example 1, except that 6 hour dispersing treatment with a dyno-mill (using zirconia beads: external diameter 2 mm) is used in place of dispersing treatment with a wet jet mill dispersing machine in Example 7, and a baking temperature is 340° C. in Example 8. PMDA in Table 3 means pyromellitic acid dianhydride.

TABLE 3

| | Example 5 | Example 6 | Example 7 | Comparative example 6 |
|---|---|---|---|---|
| Poly-amide acid moiety | BPDA, PDA (trade name: U IMIDE TX, manufactured by Unitika Ltd.) | BPDA, PDA (trade name: U IMIDE TX, manufactured by Unitika Ltd.) | BPDA, PDA (trade name: U IMIDE TX, manufactured by Unitika Ltd.) | BPDA, ODA (trade name: U IMIDE KX, manu-factured by Unitika Ltd.) |
| Carbon black | SB4A (27 parts) | SB4A (17 parts) | SB4A (27 parts) | SB4A (20 parts) SB250 (5 parts) |
| | **Comparative example 7** | **Comparative example 8** | **Comparative example 9** | **Comparative example 10** |
| Poly-amide acid moiety | BPDA, ODA (trade name: U IMIDE KX, manufactured by Unitika Ltd.) | PMDA, ODA (trade name: U IMIDE MX, manufactured by Unitika Ltd.) | PMDA, ODA (trade name: U IMIDE MX, manufactured by Unitika Ltd.) | PMDA, ODA (trade name: U IMIDE MX, manu-factured by Unitika Ltd.) |
| Carbon black | SB4A (15 parts) SB250 (15 parts) | SB4A (27 parts) | SB4A (20 parts) SB250 (5 parts) | SB4A (24 parts) SB250 (2 parts) |

Each of the resulting polyimide belts is measured for a surface resistivity as in Table 1. Measurement results are shown in Table 4.

Measurement of Young's Modulus

Each of polyimide belts of Examples 1, 5 to 7, and Comparative Examples 6 to 10 is cut into 80 mm×5 mm, and measurement of a Young's modulus is performed ten times, and an average value is adopted as measurement data. As a measuring machine, a tensile tester MODEL-1605N (described above) is used, and measuring condition is a tensile speed of 20 mm/min in the 22° C. 55% environment. As a belt thickness necessary for calculating a belt cross-sectional area, an average obtained by five times measurement with an eddy current-format thickness meter CTR-1500E (described above) is used. Results are shown in Table 4.

Quality of Copied Image

Using a modified machine of DOCUCENTRE COLOR 2220 (described above) (modified to be process speed : 250 mm/sec, primary transfer current: 35 μA), 50% half tones of Cyan and Magenta are inputted on a C2 PAPER (trade name, manufactured by Fuji Xerox Co., Ltd.) under high temperature high humidity (28° C. 85% RH) and low temperature low humidity (10° C. 15% RH), and an unevenness in image density and a spot defect are assessed visually under the following criteria. Results are shown in Table 4.

Unevenness in Image Density

A: Unevenness in image density is not confirmed.

B: Unevenness in image density is slightly confirmed, but this is a problemless level.

C: Unevenness in image density is clearly confirmed.

Spot Defect

A: A spot defect is not confirmed.

B: A spot defect is slightly confirmed, but this is a problemless level.

C: A spot defect is clearly confirmed.

TABLE 4

| | Example 1 | Example 5 | Example 6 | Example 7 | Comparative example 6 | Comparative example 7 | Comparative example 8 | Comparative example 9 | Comparative example 10 |
|---|---|---|---|---|---|---|---|---|---|
| Surface resistivity after 30 msec Log SR (LogΩ/□) | 11.5 | 11.2 | 11.2 | 11.0 | 11.8 | 11.7 | 11.2 | 11.6 | 11.2 |
| Defference in surface resistivity at 10 sec-30 msec (LogΩ/□) | 0.11 | 0.12 | 0.17 | 0.12 | 0.31 | 0.45 | 0.15 | 0.28 | 0.22 |
| Young's modulus (MPa) | 4100 | 5980 | 4000 | 3800 | 4200 | 3800 | 2900 | 3000 | 4000 |
| Unevenness in image density | A | A | B | A | C | C | A | C | C |
| Spot defect | A | A | A | B | A | B | C | C | A |

As is understood from Table 4, both of an unevenness in image density, and a spot defect are reduced in Examples 5 and 6 using the intermediate transfer belt of the invention.

What is claimed is:

1. An intermediate transfer belt, wherein: the intermediate transfer belt is made from a resin material comprising a carbon black in a dispersed state; the composition of the intermediate transfer belt is made so as to have properties of an absolute value of a difference between a common logarithm value of surface resistivity 10 seconds after voltage application and a common logarithm value of the surface resistivity 30 milliseconds after voltage application is about 0.2 (Log Ω/□) or less, and a Young's modulus of about 3,500 MPa or more.

2. An intermediate transfer belt according to claim 1, wherein the common logarithm value of the surface resistivity 30 milliseconds after voltage application is about 9 to 13 (Log Ω/□).

3. An intermediate transfer belt according to claim 1, wherein the common logarithm value of the surface resistivity 30 milliseconds after voltage application is 10 to 12 (Log Ω/□).

4. An intermediate transfer belt according to claim 1, wherein a common logarithm value of volume resistivity is in a range of about 8 to 13 (Log Ωcm ).

5. An intermediate transfer belt according to claim 1, wherein a surface micro hardness of a transfer surface of the intermediate transfer belt is about 30 or smaller.

6. An intermediate transfer belt according to claim 1, wherein a surface micro hardness of a transfer surface of the intermediate transfer belt is about 25 or smaller.

7. An intermediate transfer belt according to claim 1, wherein the Young's modulus is over about 4,000 and less than about 10,000 MPa.

8. An intermediate transfer belt according to claim 1, wherein a total thickness of the intermediate transfer belt is in a range of about 0.05 to 0.5 mm.

9. An intermediate transfer belt according to claim 1, wherein the resin material comprises a polyimide resin as a main component.

10. An intermediate transfer belt according to claim 1, wherein the carbon black is an acidic carbon black having a pH of 5 or lower.

11. An intermediate transfer belt according to claim 9, wherein the intermediate transfer belt is formed by a process comprising:

dispersing the carbon black in a polyamide acid solution so as to prepare a dispersant;

developing the dispersant in a ring-like shape to form a developing layer;

drying the developing layer to make a film to mold into a belt shape to form a molded article; and heat-treating the molded article to convert polyamide acid into imide.

12. An image forming device comprising:

a first transfer apparatus for primarily transferring a toner image formed on an image bearing body onto an intermediate transfer belt; and a second transfer apparatus for secondarily transferring the toner image transferred onto the intermediate transfer belt onto a transfer medium, wherein the intermediate transfer belt is made from a resin material comprising a carbon black in a dispersed state; and the transfer belt is made so as to have the properties of an absolute value of a difference between a common logarithm value of surface resistivity 10 seconds after voltage application and a common logarithm value of the surface resistivity 30 milliseconds after voltage application is 0.2 (Log Ω/□) or less, and a Young's modulus of about 3,500 MPa or more.

13. An image forming device according to claim 12, wherein the common logarithm value of the surface resistivity 30 milliseconds after voltage application is about 9 to 13 (Log Ω/□).

14. An image forming device according to claim 12, wherein the common logarithm value of the surface resistivity 30 milliseconds after voltage application is 10 to 12 (Log Ω/□).

15. An image forming device according to claim 12, wherein a common logarithm value of volume resistivity is in a range of about 8 to 13 (Log Ωcm).

16. An image forming device according to claim 12, wherein a surface micro hardness of a transfer surface of the intermediate transfer belt is about 30 or smaller.

17. An image forming device according to claim 12, wherein a surface micro hardness of a transfer surface of the intermediate transfer belt is about 25 or smaller.

18. An image forming device according to claim 12, wherein the Young's modulus is over about 4,000 and less than about 10,000 MPa.

19. An image forming device according to claim 12, wherein a total thickness of the intermediate transfer belt is in a range of about 0.05 to 0.5 mm.

20. An image forming device according to claim 12, wherein the carbon black is an acidic carbon black having a pH of 5 or lower.

* * * * *